US007896195B2

(12) United States Patent
Limback et al.

(10) Patent No.: US 7,896,195 B2
(45) Date of Patent: Mar. 1, 2011

(54) TABLET DISPENSER WITH ISOLATED PRODUCT HOPPER

(75) Inventors: Scott R. Limback, Saint Paul, MN (US); Louis M. Holzman, Saint Paul, MN (US)

(73) Assignee: Ecolab Inc., St. Paul, MN (US)

( * ) Notice: Subject to any disclaimer, the term of this patent is extended or adjusted under 35 U.S.C. 154(b) by 1346 days.

(21) Appl. No.: 10/862,925

(22) Filed: Jun. 8, 2004

(65) Prior Publication Data

US 2005/0269346 A1 Dec. 8, 2005

(51) Int. Cl.
*B65H 3/00* (2006.01)
*B65H 5/00* (2006.01)

(52) U.S. Cl. ..... 221/265; 221/263; 221/264

(58) Field of Classification Search ..... 221/265, 221/263, 264; 206/536, 540
See application file for complete search history.

(56) References Cited

U.S. PATENT DOCUMENTS

| | | | | |
|---|---|---|---|---|
| 2,664,223 | A | 12/1953 | Dobkin | |
| 3,178,915 | A | 4/1965 | Hertel | |
| 3,410,450 | A | 11/1968 | Fortenberry | |
| 3,785,525 | A | 1/1974 | Handeland | |
| 4,150,766 | A * | 4/1979 | Westendorf et al. | 221/112 |
| 4,405,060 | A | 9/1983 | Hsei | |
| 4,573,606 | A | 3/1986 | Lewis et al. | |
| 4,676,399 | A | 6/1987 | Burckhardt | |
| 4,694,900 | A | 9/1987 | Behrens | |
| 4,711,370 | A | 12/1987 | Goudy, Jr. et al. | |
| 4,723,690 | A * | 2/1988 | vom Hofe | 221/96 |
| 4,832,235 | A * | 5/1989 | Palmer | 222/370 |
| 5,014,877 | A * | 5/1991 | Roos | 221/265 |
| 5,035,237 | A | 7/1991 | Newell et al. | |
| 5,064,094 | A | 11/1991 | Roos et al. | |
| 5,078,299 | A | 1/1992 | Keating | |
| 5,147,615 | A | 9/1992 | Bird et al. | |
| 5,243,970 | A * | 9/1993 | Ambrosio et al. | 128/203.15 |

(Continued)

FOREIGN PATENT DOCUMENTS

DE 195 40 958 A1 5/1997

(Continued)

OTHER PUBLICATIONS

Osmonics, Inc., Autotrol® Brand Chlorination Equipment, Optional Accessories Brochure, Jan. 20, 2001, Minnetonka, Minnesota.

(Continued)

*Primary Examiner* — Stefanos Karmis
*Assistant Examiner* — Michael E Butler
(74) *Attorney, Agent, or Firm* — Andrew D. Sorensen; Laura C. Dilorenzo; Amy J. Hoffman

(57) ABSTRACT

A preferred embodiment dispenser for dispensing product tablets includes a first disk member, a second disk member, and a third disk member. The first disk member is rotatable and includes a first aperture extending longitudinally through the first disk member. The second disk member is stationary and includes a second aperture extending longitudinally through the second disk member. The third disk member is rotatable and includes a third aperture extending longitudinally through the third disk member. The second aperture is intermittently aligned with the first aperture and the third aperture, the first aperture and the third aperture being positioned at different locations with respect to the second aperture thereby aligning with the second aperture at separate times resulting in an interrupted flow path for the product tablets.

11 Claims, 13 Drawing Sheets

U.S. PATENT DOCUMENTS

| | | | | |
|---|---|---|---|---|
| 5,323,929 | A * | 6/1994 | Marlar | 221/3 |
| 5,522,525 | A * | 6/1996 | McLaughlin et al. | 221/4 |
| 5,549,217 | A * | 8/1996 | Benarrouch | 221/155 |
| 5,636,470 | A | 6/1997 | Blomquist | |
| 5,765,606 | A * | 6/1998 | Takemasa et al. | 141/104 |
| 5,791,127 | A * | 8/1998 | Rossi | 53/559 |
| 5,829,085 | A | 11/1998 | Jerg et al. | |
| 6,283,339 | B1 * | 9/2001 | Morrow | 222/452 |
| 6,415,954 | B1 | 7/2002 | Lee | |
| 6,450,371 | B1 | 9/2002 | Sherman et al. | |
| 6,497,342 | B2 * | 12/2002 | Zhang et al. | 221/265 |
| 6,547,097 | B1 | 4/2003 | Cavallaro et al. | |
| 6,929,159 | B1 * | 8/2005 | Haig | 222/456 |
| 7,219,703 | B2 | 5/2007 | Geltser et al. | |
| 2002/0117511 | A1 | 8/2002 | McNabb et al. | |
| 2004/0065670 | A1 | 4/2004 | Morgan et al. | |

FOREIGN PATENT DOCUMENTS

| | | |
|---|---|---|
| DE | 196 52 787 A1 | 7/1998 |
| EP | 1 159 913 A1 | 12/2001 |
| EP | 1174363 | 1/2002 |
| WO | WO 91/06496 | 5/1991 |
| WO | WO 02/058528 | 8/2002 |

OTHER PUBLICATIONS

Photo 1(a), perspective view of Autotrol® Chlorinator by Osmonics, Inc. of Minnetonka, Minnesota, Jan. 20, 2001.

Photo 2(b), top view of Autotrol® Chlorinator by Osmonics, Inc. of Minnetonka, Minnesota, Jan. 20, 2001.

Med Associates Inc., Bio-Serv® Pellet Dispenser & Pellet Receptacle, 1995, St. Albans, Vermont.

Photo 2(a), front perspective view of Bio-Serv® Pellet Dispenser by Med Associates Inc. of St. Albans, Vermont, 1995.

Photo 2(b), top view of Bio-Serv® Pellet Dispenser by Med Associates Inc. of St. Albans, Vermont, 1995.

Photo 2(c), side view of the metering and dispensing portion of Bio-Serv® Pellet Dispenser by Med Associates Inc. of St. Albans, Vermont, 1995.

Photo 2(d), side view of the metering and dispensing portion of Bio-Serv® Pellet Dissenser by Med Associates Inc. of St. Albans, Vermont, 1995.

* cited by examiner

TABLET DISPENSER WITH ISOLATED PRODUCT HOPPER

BACKGROUND OF THE INVENTION

1. Field of the Invention

The present invention relates to a product tablet dispenser with an isolated product hopper containing a plurality of product tablets.

2. Description of the Prior Art

Solid product compositions in tablet form are typically used because they are relatively easy to formulate and dispense in a desired dosage. Such product tablets may be used for a variety of products including detergents, sanitizers, rinse aids, fabric softeners, bleaches, optical brightening chemicals, starching chemicals, and cleaners and sanitizers in general. However, depending upon the type of product, the product tablets may be caustic, messy, or otherwise difficult to handle and/or susceptible to environmental conditions such as humidity or other chemicals that can cause the product to clump or dissolve and disrupt the dispensing of the product.

Dispensers are typically used to dispense product tablets. The use of dispensers reduces the handling of the product tablets and allows for easy dispensing of the product in the desired dosage. For dispensers including hoppers containing a plurality of product tablets, the prior art dispensers are typically not effective in reducing exposure of the product tablets to the environmental conditions in which the product tablets are dispensed. As a result of being exposed to the environmental conditions, the product tablets may clump or dissolve thereby clogging the dispenser. If the dispenser becomes clogged, the dispenser will not dispense the product tablets properly.

Prior art dispensers also include outlets with various types of sensors. One type of outlet that has been used includes a tube with two small holes on opposite sides of the tube, and a beam of light is emitted and received through the holes in the tube. As a product tablet is dispensed through the outlet, the product tablet momentarily interrupts the reception of the beam of light, and the sensor provides a signal pulse indicating that the product tablet has been dispensed. A drawback to this configuration is that it can result in blockage of the holes through which the beam of light passes thereby disabling the operation of the sensor. For example, the holes could be blocked by powder or small particles of the product tablets being dispensed, condensation, residual product, and other residue such as from evaporation of chemical laden moisture from the dishwashing machine.

It is desired to provide a tablet dispenser that will protect the product tablets from exposure to various environmental conditions such as moisture and chemicals during use of a dishwashing machine and to prevent interference with the operation of the sensors.

SUMMARY OF THE INVENTION

A preferred embodiment dispenser for dispensing product tablets includes a first disk member, a second disk member, and a third disk member. The first disk member includes a first aperture extending longitudinally through the first disk member, and the first disk member is rotatable. The second disk member includes a second aperture extending longitudinally through the second disk member, and the second disk member is stationary. The first aperture is intermittently aligned with the second aperture. The third disk member includes a third aperture extending longitudinally through the third disk member, and the third disk member is rotatable. The third disk member is intermittently aligned with the second aperture. The third aperture and the first aperture are positioned at different locations with respect to the second aperture thereby aligning with the second aperture at separate times resulting in an interrupted flow path for the product tablets.

A preferred embodiment tablet dispenser includes a hopper and an interrupted flow path. The hopper has a cavity configured and arranged to contain a plurality of product tablets. The interrupted flow path is in fluid communication with the cavity of the hopper. The flow path includes a first disk member having a first aperture, a second disk member having a second aperture, and a third disk member having a third aperture. A predetermined quantity of product tablets enter the first aperture, the first disk member is rotated to align the first aperture and the second aperture, the predetermined quantity of product tablets flow from the first aperture into the second aperture, the third disk member is rotated to align the second aperture and the third aperture, the predetermined quantity of product tablets flow from the second aperture into the third aperture, and the predetermined quantity of product tablets are dispensed. The flow path is sealed by the disk members to prevent exposure of the plurality of product tablets contained within the hopper to outside elements.

A preferred embodiment dispenser for dispensing product tablets includes a hopper, a first disk member, a second disk member, a third disk member, a motor, and a flow path. The hopper has a cavity and a bottom. The cavity is configured and arranged to contain the product tablets, and the bottom includes an opening providing access to the cavity. The first disk member is configured and arranged to fit within the cavity proximate the opening of the hopper. The first disk member includes a first aperture extending longitudinally through the first disk member. The second disk member, to which the bottom of the hopper is operatively connected, is stationary and includes a bore and a second aperture. The bore extends longitudinally through the second disk member proximate a center portion of the second disk member. The second aperture extends longitudinally through the second disk member and is intermittently aligned with the first aperture. The third disk member includes a boss and a third aperture. The boss extends through the bore of the second disk member and interconnects the third disk member and the first disk member. The third disk member and the first disk member are rotatable. The third aperture extends longitudinally through the third disk member and is intermittently aligned with the second aperture. The third aperture and the first aperture are positioned at different angles with respect to the second aperture. The motor is operatively connected to the third disk member, and the motor rotates the third disk member thereby rotating the first disk member. The flow path is created by aligning the apertures. The first aperture aligns with the second aperture and the third aperture aligns with the second aperture as the first disk member and the third disk member are rotated by the motor, wherein the flow path is interrupted thereby isolating the hopper from outside elements.

DETAILED DESCRIPTION OF A PREFERRED EMBODIMENT

Figure 1:
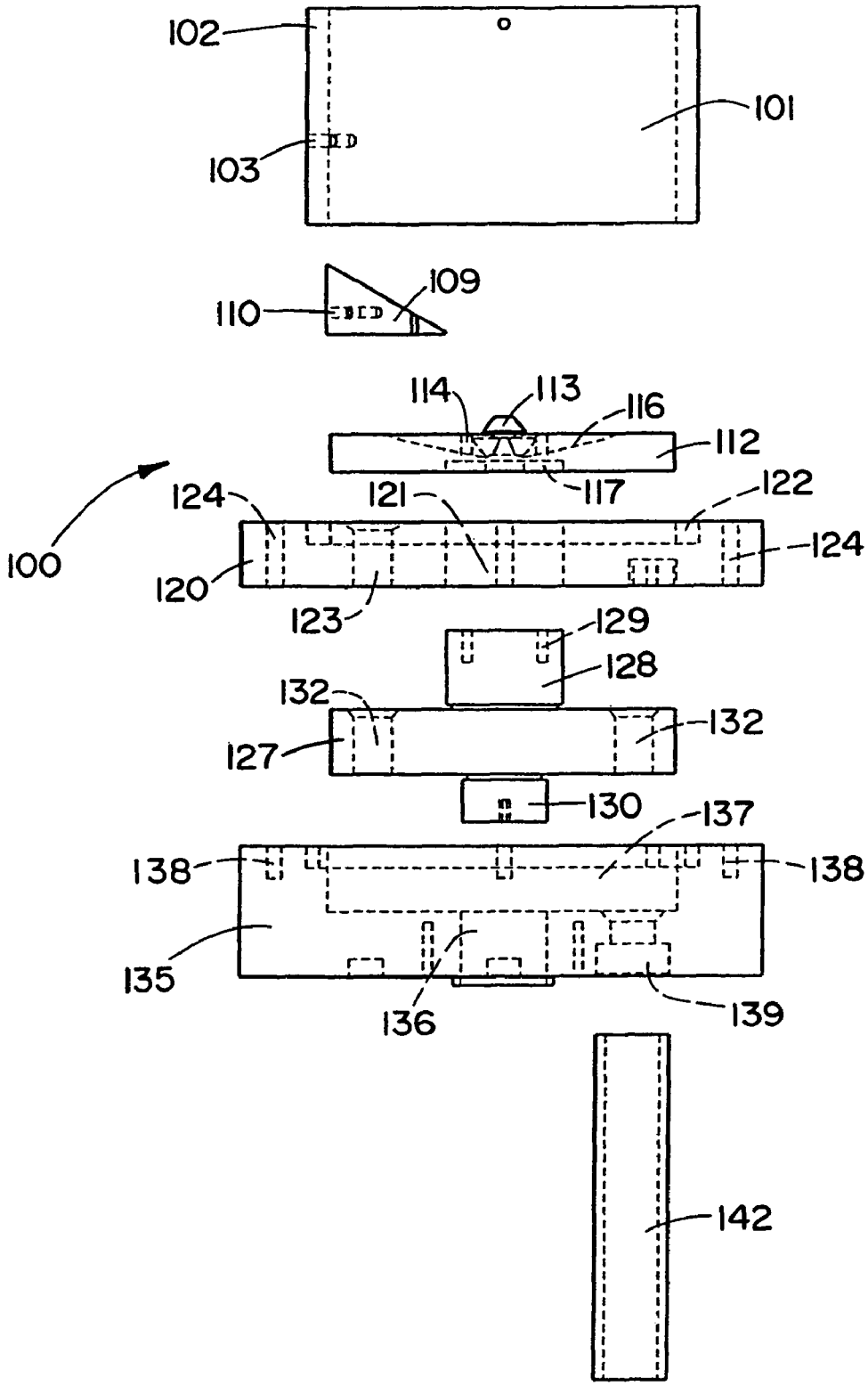
FIG. 1 is an exploded side view of a tablet dispenser constructed according to the principles of the present invention.

A preferred embodiment tablet dispenser constructed according to the principles of the present invention is designated by the numeral 100 in the drawings.

The preferred embodiment tablet dispenser 100 is preferably mounted to the top of the dishwashing machine and used to dispense a product such as a sanitizer in tablet form into a dishwashing machine (not shown) with proof of delivery to the user. The tablet dispenser 100 ensures that the use solution including the sanitizer is in the desired range of 50 to 100 ppm after the product tablet is dissolved. Because the environment in which the product tablet is dispensed includes moisture and vapor, it is desirable to isolate the product tablets within the tablet dispenser 100 from the humid environment within the dishwashing machine. It is recognized that the tablet dispenser 100 may be used to dispense many different types of products for use in many different types of applications and is not limited to the products and the applications described herein. For example, the present invention could also be used for detergents, rinse aids, fabric softeners, bleaches, optical brightening chemicals, starching chemicals, manual dishwashing products, cleaning products used in spray bottles or mop buckets, laundry products, animal feed supplements, and other suitable products. Further, the term "tablets" is used throughout, and it is understood that the term "tablets" includes product in the form of tablets, pellets, granules, or other suitable forms well known in the art.

The tablet dispenser 100 includes a hopper 101, a dispensing mechanism including disk members creating an interrupted flow path through which product tablets 168 are dispensed, a motor or gear head 172 to drive the disk members, an outlet conduit 142, and a sensor mechanism 155 to provide indication of proof of delivery of the product tablets 168.

Figure 2:
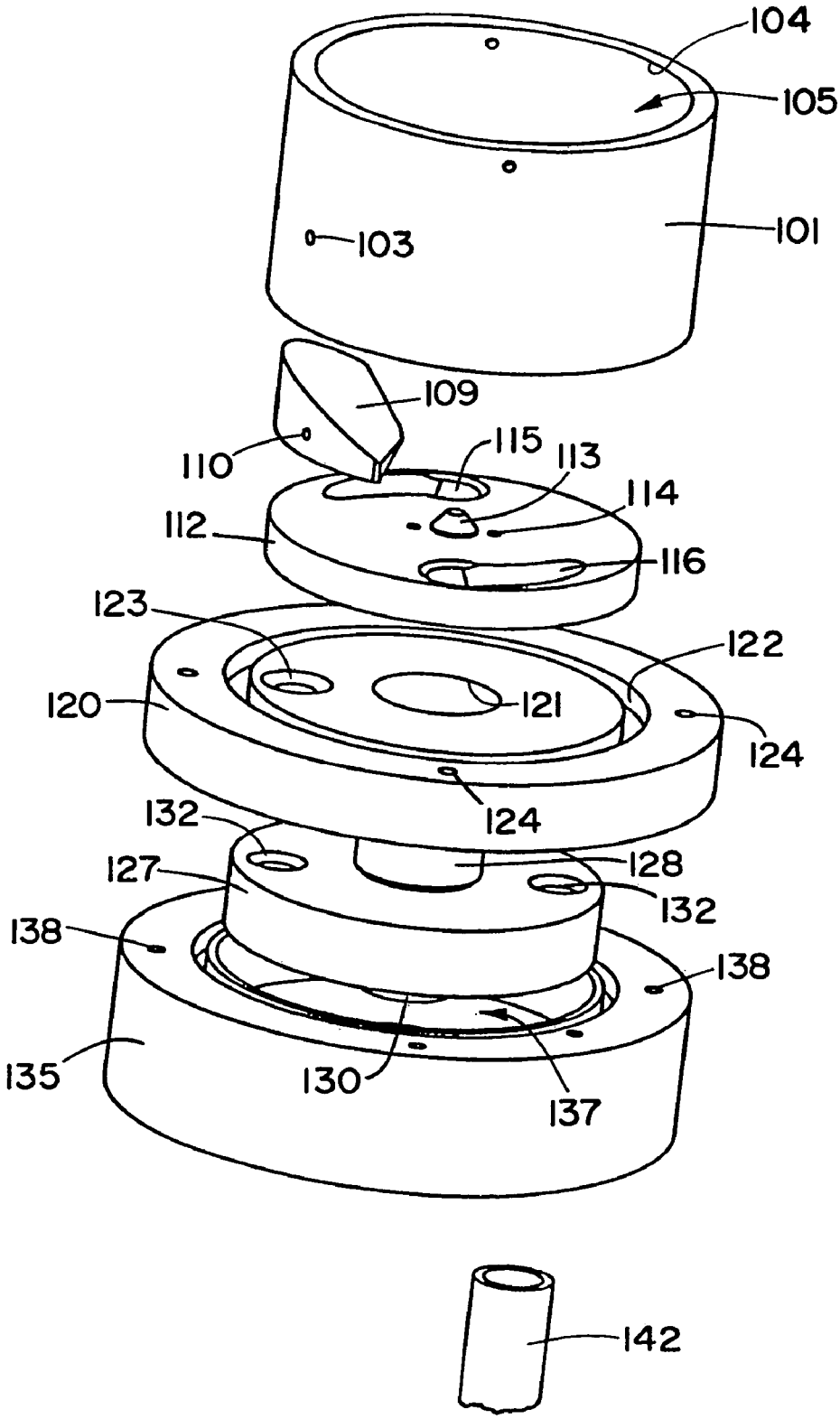
FIG. 2 is an exploded top perspective view of the tablet dispenser shown in FIG. 1.
Figure 3:
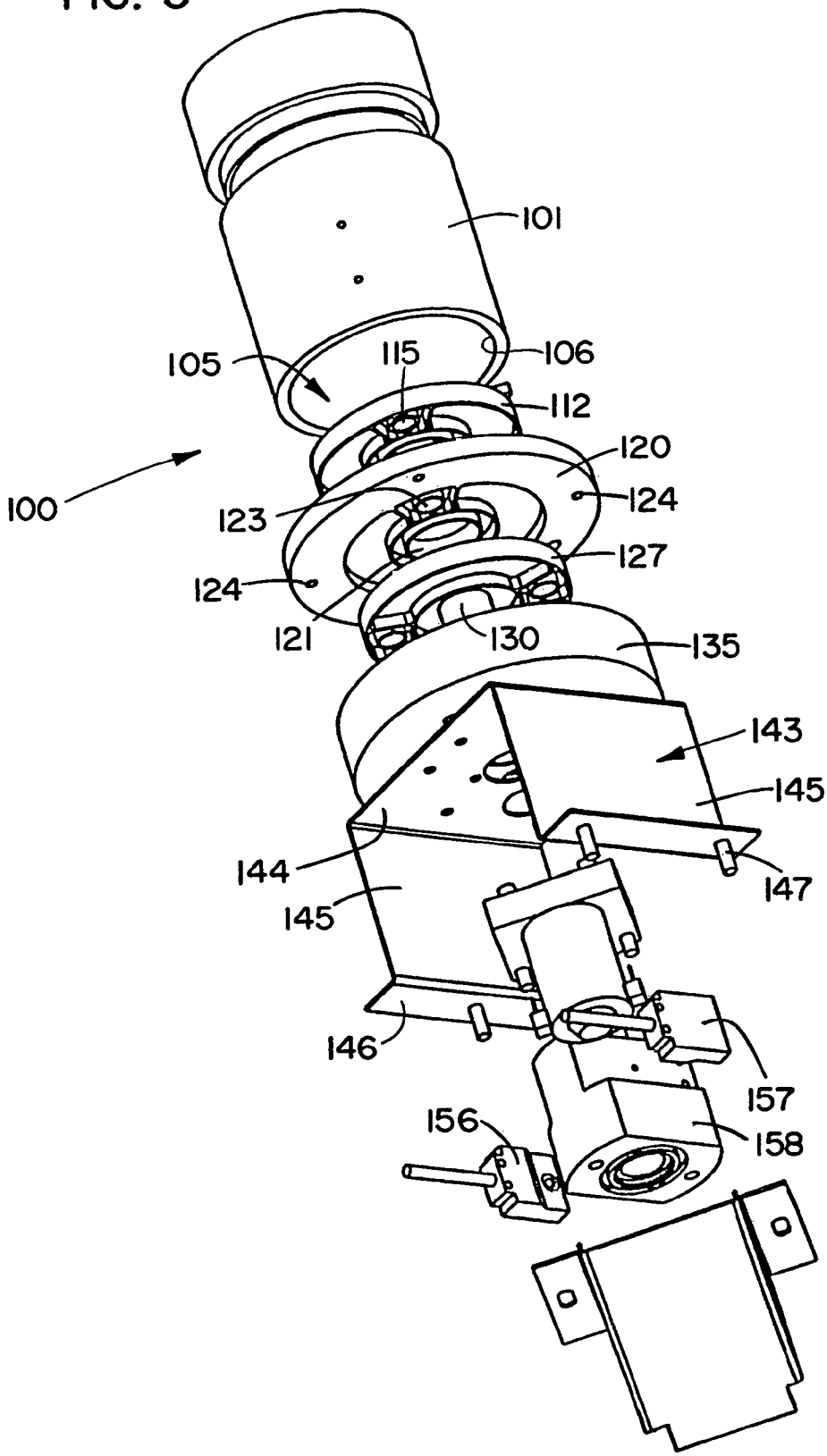
FIG. 3 is an exploded bottom perspective view of the tablet dispenser shown in FIG. 1.

As shown in FIGS. 1-3, the hopper 101 includes a side wall 102, which is preferably a hollow cylindrical housing with a top opening 104, a bottom opening 106, and a cavity 105 configured and arranged to contain the plurality of product tablets 168. The hopper 101 is used to store the product tablets 168 and is preferably located above the disk members. A wiper 109 may be operatively connected to the side wall 102 of the hopper 101 proximate the bottom of the hopper 101. The wiper 109 is preferably a wedge shaped member. A fastener (not shown) may be inserted through an aperture 103 in the side wall 102 and an aperture 110 in the wiper 109 to operatively connect the wiper 109 to the hopper 101.

The first disk member 112 preferably has a diameter slightly smaller than the inside diameter of the bottom of the hopper 101 so that the first disk member 112 fits within the cavity 105 proximate the bottom of the hopper 101. A hub 113 is operatively connected to the top of the first disk member 112 proximate the center thereof, and the hub is preferably frustoconical shaped to guide the product tablets 168 away from the center of the first disk member 112 to assist in minimizing the number of un-dispensed product tablets 168. Apertures 114 extend longitudinally through the first disk member 112 on opposing sides of the hub 113 proximate the center of the first disk member 112, and dispensing apertures 115 extend longitudinally through the first disk member 112 on opposing sides of the hub 113 proximate the edge of the first disk member 112.

Preferably, the dispensing apertures 115 are placed 90 degrees from the apertures 114. Although the dispensing apertures 115 preferably each contain one whole product tablet 168, it is recognized that the product tablets 168 may become broken so the dispensing apertures 115 are configured and arranged to contain the equivalent of one to two product tablets 168, broken and/or whole. Therefore, the term "product tablet" or "product tablets" used throughout includes whole tablets and/or portions of whole tablets. Although two dispensing apertures 115 are shown, it is recognized that one or more dispensing apertures may be used. Further, the top of the first disk member 112 may also include dispensing ramps 116, which are declining, sloped grooves approaching the dispensing apertures 115. The bottom of the first disk member 112 includes a recess 117 proximate the center of the first disk member 112 below the hub 113.

The second disk member 120 preferably has a diameter greater than the diameter of the bottom of the hopper 101 and includes a groove 122 into which the bottom of the side wall 102 of the hopper 101 is placed to operatively connect the hopper 101 to the second disk member 120. The second disk member 120 and the hopper 101 are preferably stationary. A bore 121 extends longitudinally through the center of the second disk member 120, and a dispensing aperture 123 extends longitudinally through the second disk member 120 between the bore 121 and the groove 122, more proximate the groove 122, so that the dispensing aperture 123 intermittently aligns with the dispensing apertures 115 of the first disk member 112. The second disk member 120 also includes apertures 124 between the groove 122 and the edge of the second disk member 120. There are preferably four apertures 124 approximately 90 degrees apart from one another.

Figure 6:
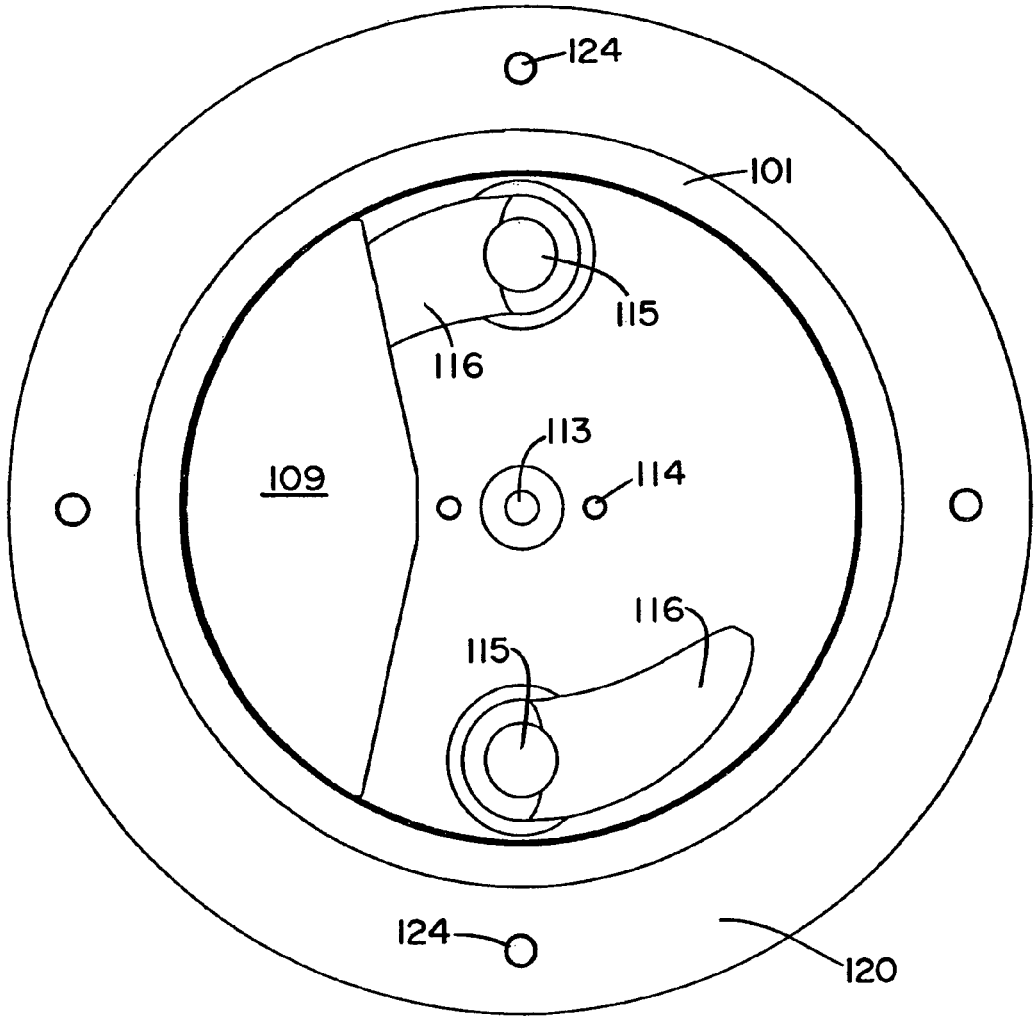
FIG. 6 is a top view of the tablet dispenser shown in FIG. 1 including a first disk member having a first dispensing aperture in a first position.
Figure 7:
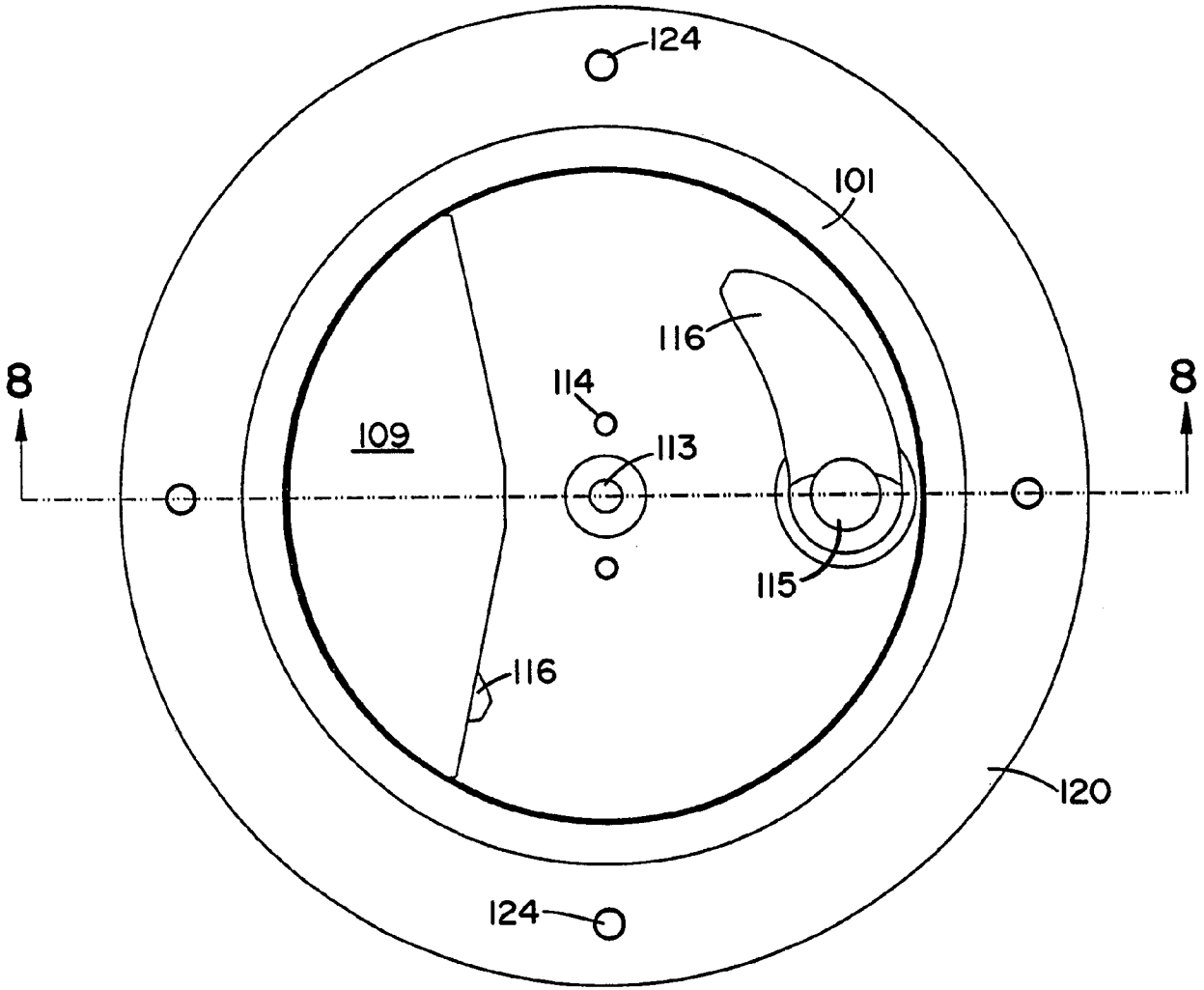
FIG. 7 is another top view of the tablet dispenser shown in FIG. 1 including the first disk member having the first dispensing aperture shown in FIG. 6 in a second position.

The wiper 109 mounted to the hopper 101 is also stationary and is preferably positioned proximate the first disk member 112 and aligned with the dispensing aperture 123. As shown in FIGS. 6 and 7, the wiper 109 preferably does not contact the hub 113, which guides the product tablets 168 away from the center of the first disk member 112 to assist in minimizing the number of un-dispensed product tablets 168. As the first disk member 112 is rotated so that one of the dispensing apertures 115 aligns with the dispensing aperture 123 of the second disk member 120, the wiper 109 diverts extraneous product tablets 168 that do not fit within the approaching dispensing aperture 115 away from the dispensing aperture 115 as the dispensing aperture 115 rotates past the wiper 109. The dispensing aperture 115 is configured and arranged to contain a predetermined quantity of product tablets. In other words, the wiper 109 removes excess product tablets 168 proximate the dispensing aperture 115 as the dispensing aperture 115 is rotated proximate the dispensing aperture 123 thereby ensuring a desired number of product tablets 168 is transferred from the dispensing aperture 115 to the dispensing aperture 123 as the first disk member 112 is rotated to align the dispensing aperture 115 with the dispensing aperture 123. The wiper 109 ensures that only the desired dosage is dispensed each time one of the dispensing apertures 115 aligns with the dispensing aperture 123. Further, the ramp 116 assists in easing the extraneous product tablets 168 away from the dispensing aperture 115 and because the ramp 116 is gradual, the product tablets 168 do not get caught on an edge of the dispensing aperture 115 or crushed between the wiper 109 and the dispensing aperture 115 thereby causing the product tablets 168 to break. The wiper 109 eases excess product tablets 168 away from the dispensing aperture 115 along the ramp 116, which reduces the occurrence of breakage of the excess product tablets 168.

The third disk member 127 includes an upper boss 128 extending upward from the top proximate the center of the third disk member 127 and a lower boss 130 extending downward from the bottom proximate the center of the third disk member 127. The upper boss 128 is configured and arranged to extend through the bore 121 of the second disk member 120 and into the recess 117 of the first disk member 112. The upper boss 128 includes apertures 129 that align with apertures 114, and a fastener (not shown) is inserted into the apertures 129 and 114 to interconnect the third disk member 127 and the first disk member 112, which are preferably concurrently rotatable while the second disk member 120 is stationary. The lower boss 130 includes a notch 131 into which a coupling of a shaft of a motor 172 is inserted and operatively connected to the third disk member 127 to rotate the third disk member 127 and the first disk member 112. The third disk member 127 includes preferably two opposing dispensing apertures 132, which are preferably 90 degrees from the dispensing apertures 115 of the first disk member 112, and are intermittently aligned with the dispensing aperture 123.

Although two dispensing apertures 132 are shown, it is recognized that one or more dispensing apertures may be used. The first disk member 112 and the third disk member 127 are preferably concurrently rotated so that when the dispensing aperture 115 is aligned with the dispensing aperture 123, the dispensing aperture 132 is approximately 90 degrees behind the dispensing apertures 115 and 123 and when the dispensing aperture 132 is aligned with the dispensing aperture 123, the dispensing aperture 115 is approximately 90 degrees ahead of the dispensing apertures 123 and 132. Therefore, the dispensing apertures 115 and 132 are preferably approximately 90 degrees apart with respect to the dispensing aperture 123. It is recognized that as long as the dispensing apertures 115 and 132 do not align with the dispensing aperture 123 at substantially the same time, any number of degrees of separation is acceptable as long as there is not a direct flow path with at least a portion of the dispensing apertures 115, 123, and 132.

The fourth disk member 135, which is optional, is preferably stationary and used to connect the outlet conduit 142 to the tablet dispenser 100. The fourth disk member 135 includes a bore 136 extending longitudinally through the center of the fourth disk member 135 and a recess 137 in the top of the fourth disk member 135 proximate the center of the fourth disk member 135. The recess 137 is configured and arranged to house the third disk member 127, with the lower boss 130 extending into the bore 136. The motor 172 extends into the bore 136 and is operatively connected to the lower boss 130. Apertures 138 align with apertures 124 of the second disk member 120 and fasteners (not shown) are inserted into the apertures 138 and 124 to interconnect the fourth disk member 127 and the second disk member 120. The fourth disk member 135 also includes a dispensing aperture 139 to which the outlet conduit 142 is operatively connected, and the dispensing aperture 139 is intermittently aligned with the dispensing apertures 132 of the third disk member 127. The dispensing aperture 139 is preferably located approximately 180 degrees from the dispensing aperture 123 thereby further isolating the hopper 101 from the outlet conduit 142. When the dispensing apertures 139 and 132 align, the product tablets 168 are dispensed from the dispensing aperture 132 to the dispensing aperture 139 and then through the outlet conduit 142.

The outlet conduit 142 is preferably light transmissive meaning transparent and/or translucent. The outlet conduit 142 is preferably tubular having an interior surface and an exterior surface. The interior surface is exposed to the humid conditions of the dishwashing machine and the wall of the outlet conduit 142 acts as a barrier protecting the exterior surface from exposure to the humid conditions.

The disk members execute the dispensing of the product tablets 168 through the respective dispensing apertures in an interrupted flow path to isolate the product tablets 168 within the hopper 101 from moisture and vapor generated by the dishwashing machine. The flow path is interrupted because as the disk members rotate there is not a continuous flow of the product tablets 168 from one dispensing aperture to the next dispensing aperture. The interrupted flow path "seals" the hopper 101 from the outside elements that have entered the outlet conduit 142. Although it is recognized that some moisture and vapor or other outside elements may enter the hopper 101, the disk members seal the hopper 101 in that the disk members help prevent and limit exposure of the product tablets 168 inside the hopper 101 to moisture and vapor or other outside elements. At least three disk members should be used to effectively isolate the hopper 101 from outside elements. Preferably, each dynamic (rotatable) disk member is positioned adjacent a static (stationary) disk member to isolate the hopper 101 from the humid environment of the dishwashing machine.

Preferably, the thickness of the first disk member 112 and the diameter of the dispensing aperture 115 are configured and arranged to contain a predetermined quantity of product tablets 168 thereby ensuring that the desired dosage is dispensed. In other words, the diameter and the height of the dispensing aperture 115 define a volume in which the product tablets 168 are contained thereby selecting the dose of product tablets 168. The subsequent disk members are preferably thicker than the first disk member 112 and each subsequent dispensing aperture in the flow path has a diameter that is preferably slightly larger than the previous dispensing aperture diameter. The thicker disk members and the increasingly larger dispensing aperture diameters assist in preventing jamming of the dispenser as the product tablets are dispensed because the volumes in which the product tablets are contained increase as they move through the flow path. In addition, it is also preferable that the diameters of the dispensing apertures are tapered or at least countersunk so that the top of each dispensing aperture is smaller than the bottom of each dispensing aperture.

Although the preferred embodiment includes at least one static disk member and at least two dynamic disk members to isolate the hopper 101 from the humid environment of the dishwashing machine, it is recognized that additional disk members could be used to further isolate the hopper. The dispensing apertures could be any size or shape to accommodate varying sizes and shapes of product tablets. In addition, seal rings could be machined or molded directly onto the disk members to create a seal between the disks. It is also recognized that O-rings could be used to seal each of the dispensing apertures of the disk members against the adjacent disk member.

Figure 4:
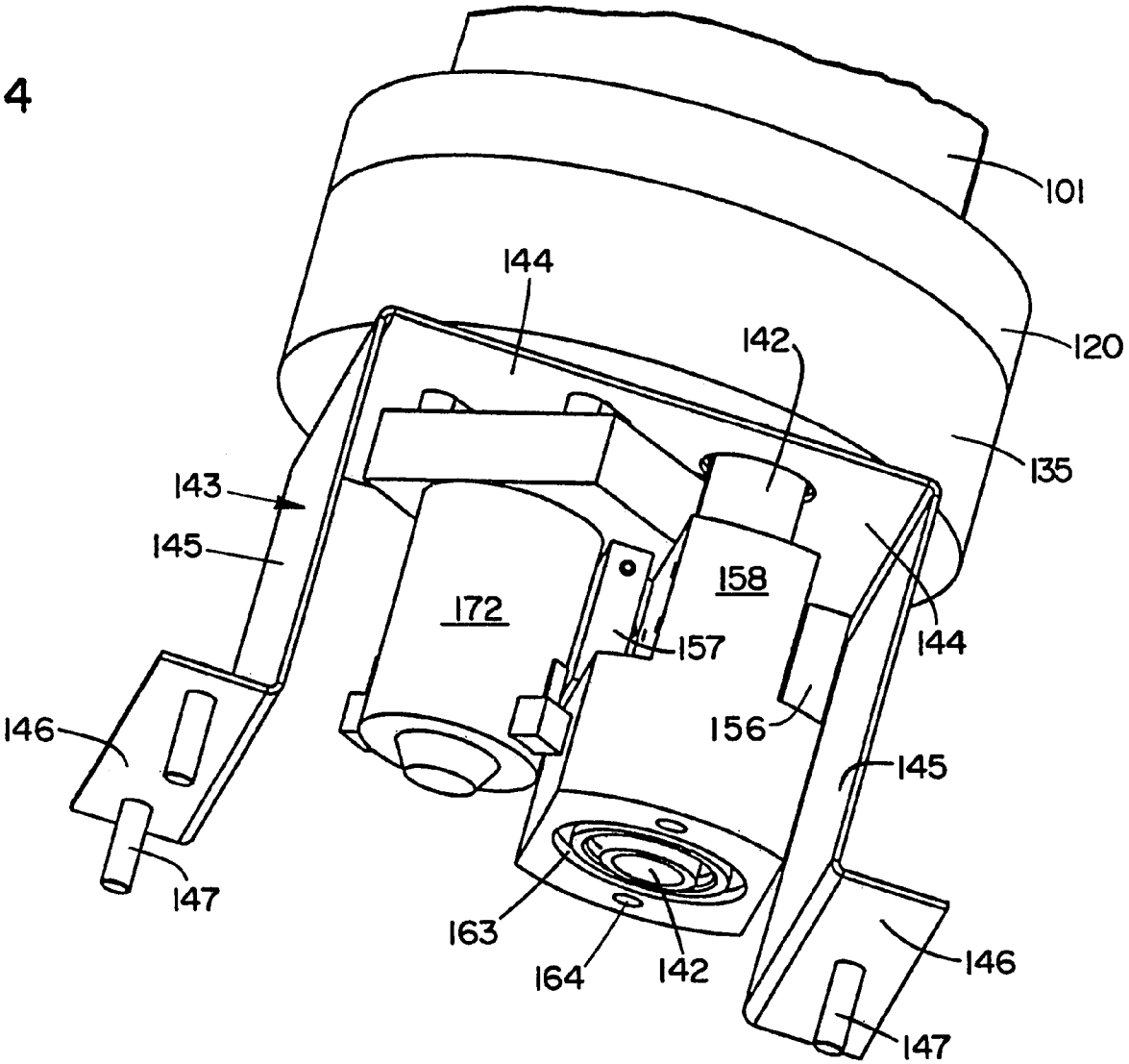
FIG. 4 is a partial bottom perspective view of the tablet dispenser shown in FIG. 1.

A frame 143, shown in FIG. 4, may be used to elevate the tablet dispenser 100 with respect to the mounting surface, such as a dishwashing machine, to accommodate the motor 172 and the sensor mechanism 155. The frame 143 is preferably an upside down U-shaped member having outward extending support members on each end. The frame 143 includes a top 144 with two sides 145 extending downward from two opposing sides of the top 144 and a flange 146 extending outward from each side 145. The top 144 supports the hopper 101 and the disk members, and the flanges 146 support the frame 143 on the mounting surface. Connectors 147 such as bolts or other suitable fasteners may be used to connect the flanges 146 of the frame 143 to the mounting surface.

Figure 5:
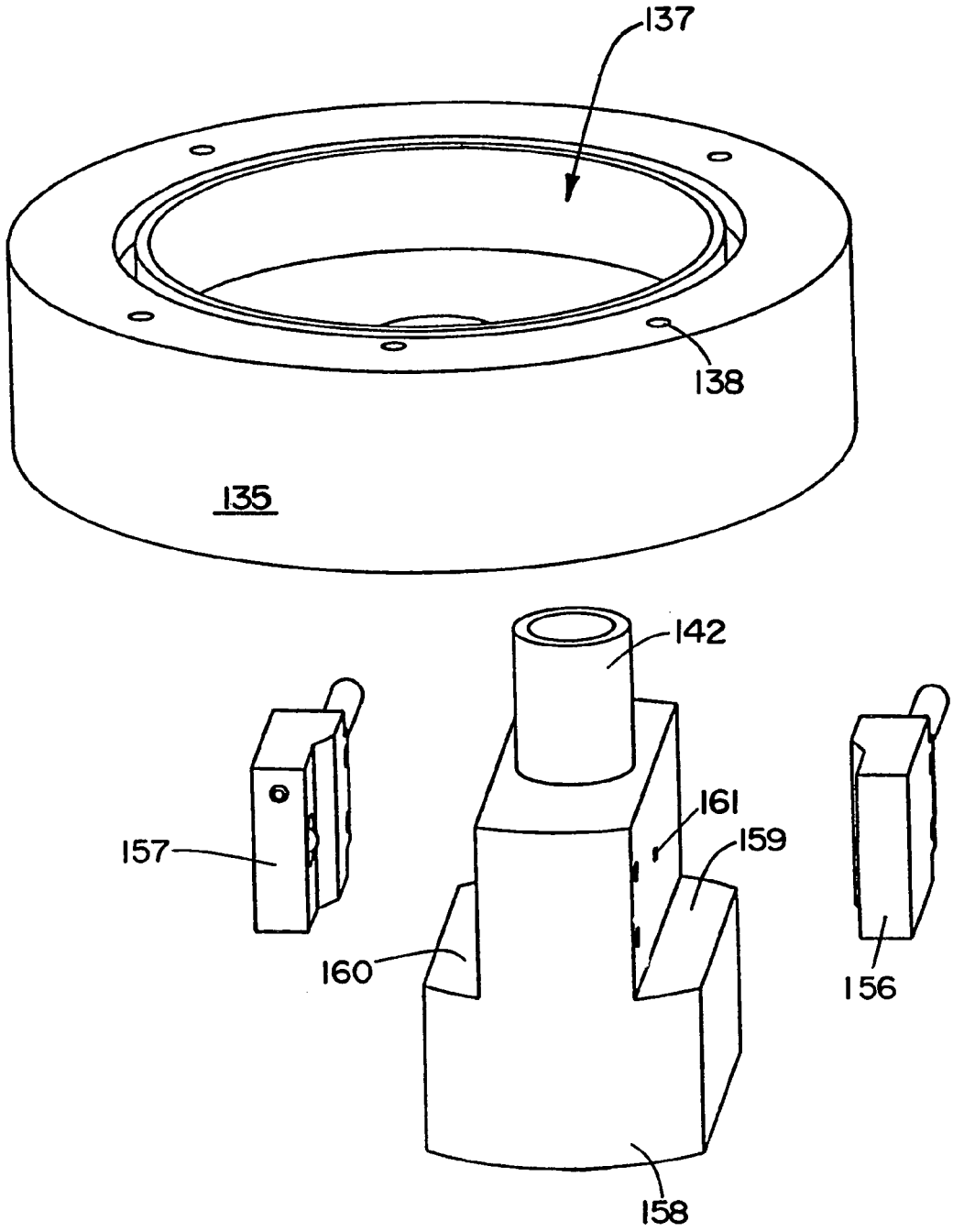
FIG. 5 is an exploded side perspective view of a sensor mechanism for use with the tablet dispenser shown in FIG. 1.
Figure 12:
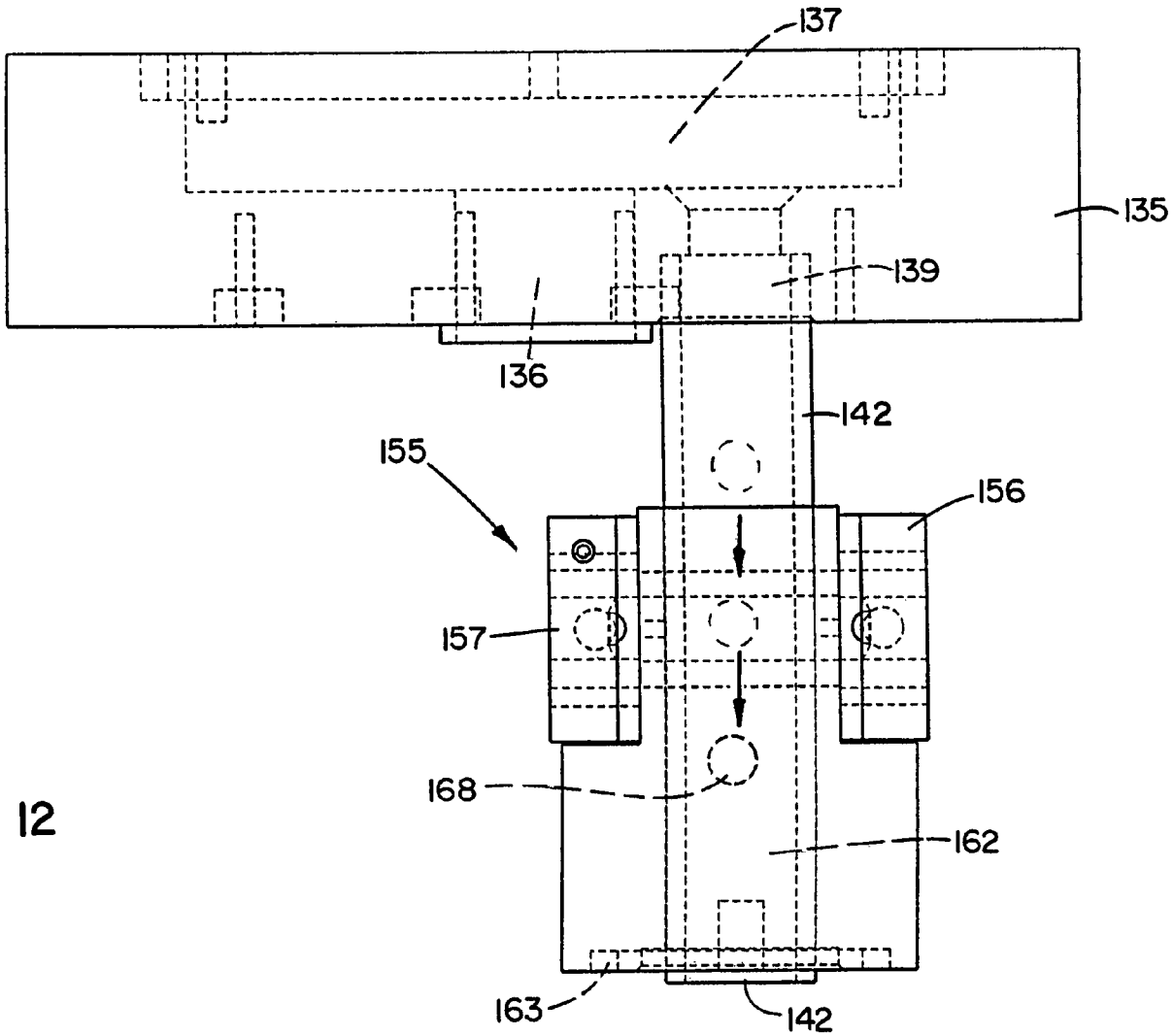
FIG. 12 is a side view of the sensor mechanism shown in FIG. 5 operatively connected to the tablet dispenser shown in FIG. 1.

The preferred sensor mechanism 155, shown in FIGS. 5 and 12, is an infrared light sensor including an emitter 156 and a receiver 157 operatively connected to a housing 158 proximate the outlet conduit 142 to provide indication of proof of delivery of the product tablets 168 into the dishwashing machine. The emitter 156 emits a light beam and the receiver 157 receives the light beam from the emitter 156. It is recognized that other suitable types of sensors could be used such as a capacitive sensor. A capacitive sensor does not require an optical transmission and includes two electrodes with a signal in between the two electrodes. The signal changes when an object is proximate the signal. The electrodes would be mounted outside the tubing, and the sensitivity of the signal would be adjusted to not sense the tubing.

The housing 158 is preferably an upside down T-shaped tubular member including a first ledge 159 for supporting the emitter 156, a second ledge 160 for supporting the receiver 157, and a bore 162 through which the outlet conduit 142 extends. The housing 158 also includes a lateral aperture 161 on each side of the housing 158, each lateral aperture 161 extending into the bore 162 to allow the beam of light being emitted from the emitter 156 and received by the receiver 157 to be transmitted through the housing and the outlet conduit 142. Fasteners (not shown) may be inserted into apertures 164 to secure and seal the housing 158 to the mounting surface such as a dishwashing machine. The bottom of the housing 158 may also include circular grooves 163 around the bore 162 for O-rings (not shown) to seal the housing 158, and therefore the outlet conduit 142, from humid conditions inside the dishwashing machine.

The outlet conduit 142 extends from the tablet dispenser 100 to the dishwashing machine, and the sensor mechanism 155 operates through the outlet conduit 142. The beam of light is emitted and received through the outlet conduit 142. Because the O-ring seals the outlet conduit 142 to the dishwashing machine, the moisture and vapors within the dishwashing machine do not escape proximate the outlet conduit 142 and the sensor mechanism 155 is protected from the humid conditions inside the dishwashing machine.

Some possible contaminants that may interfere with the operation of the sensor mechanism 155 include various types of residue such as condensation, portions of the product tablet(s), and residual product. In addition, among other possible contaminants that may interfere with the operation of the sensor mechanism 155, capillary action may cause the chemical laden moisture to seep up the outside of the outlet conduit 142 to the sensor mechanism 155 and eventually block the sensor mechanism 155. Sealing the outlet conduit 142 to the dishwashing machine helps prevent this from happening. Sealing the outlet conduit 142 to the housing 158 isolates the components of the sensor mechanism 155, including the emitter 156, the receiver 157, and the apertures 161 through which the beam of light passes. This isolation prevents the buildup of residual product and/or chemical exposure, which could obstruct the operation of the sensor mechanism 155.

The sensor mechanism 155 preferably has a relatively high speed response time, preferably a 1 ms response time. The inside diameter of the outlet conduit 142 should be small enough so that the product tablet 168 dispensed through the outlet conduit 142 will pass through the light beam transmitted through the outlet conduit 142 to interrupt the receipt of the light beam by the receiver 157. Preferably, the inside diameter of the outlet conduit 142 is slightly less than double the smallest product tablet dimension.

Figure 8:
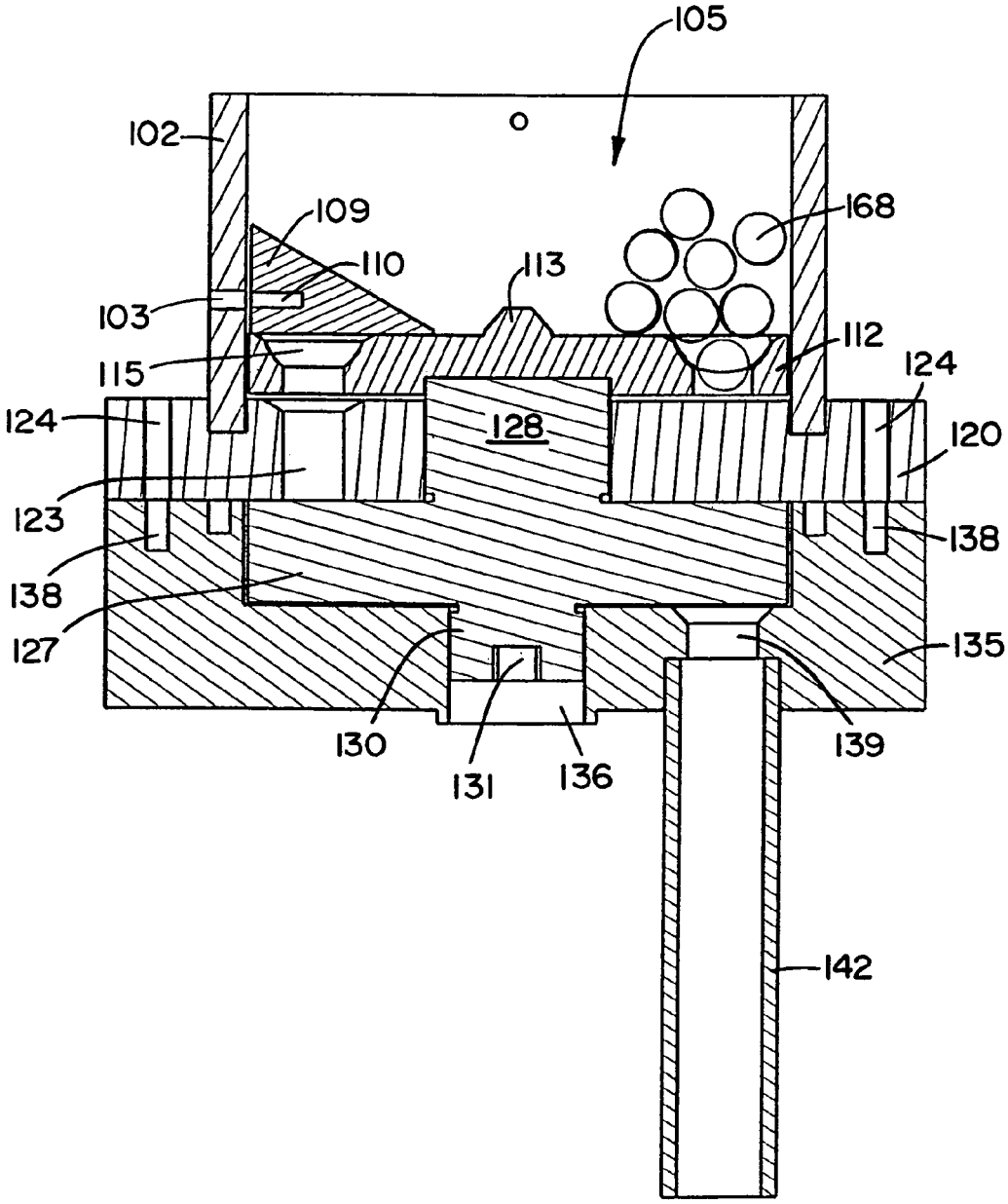
FIG. 8 is a side cross-sectional view of the tablet dispenser shown in FIG. 1 having a product tablet in the first dispensing aperture in the second position shown in FIG. 7.
Figure 9:
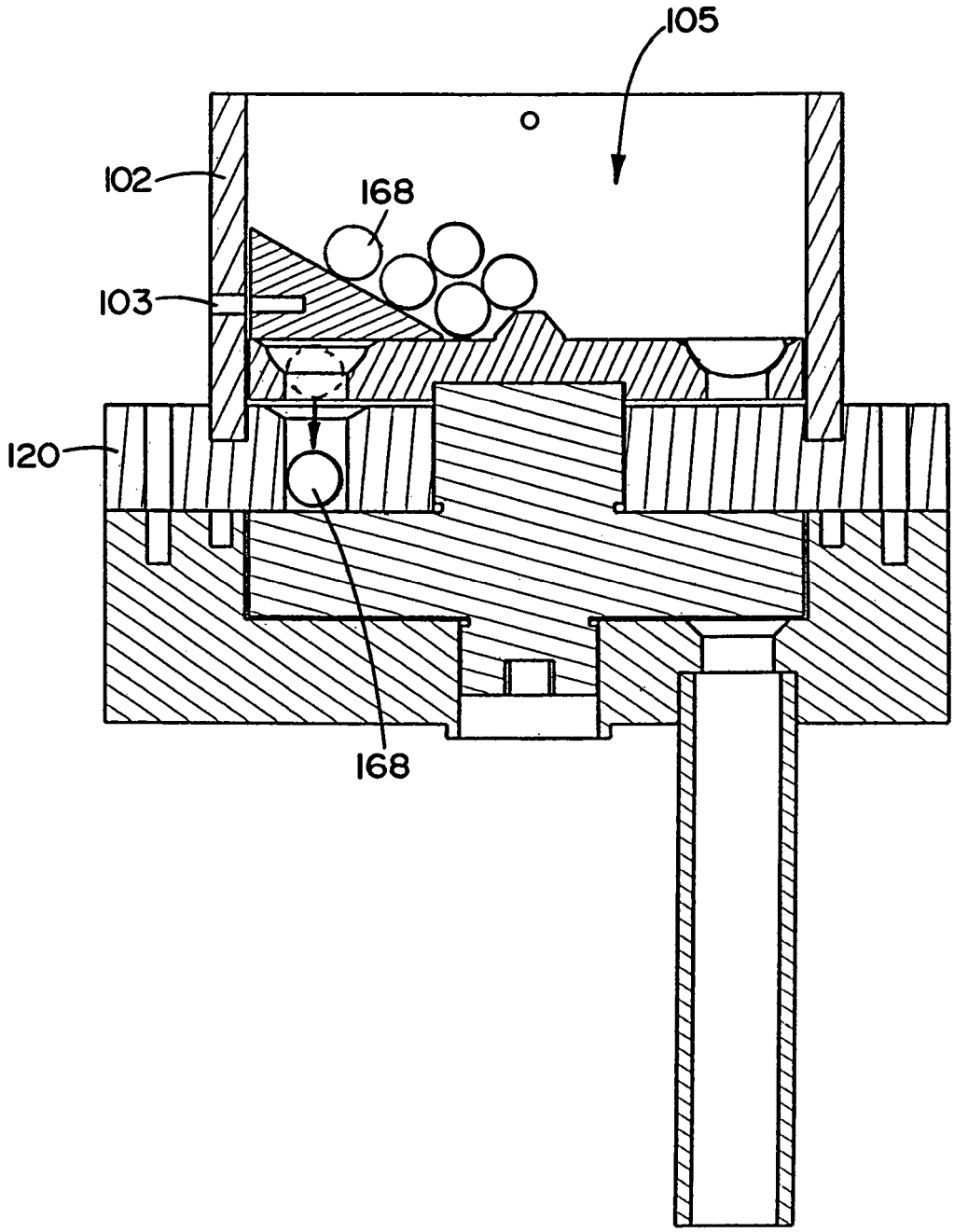
FIG. 9 is a side cross-sectional view of the tablet dispenser shown in FIG. 1 showing the product tablet being transferred from the first dispensing aperture rotated 180 degrees from the second position shown in FIGS. 7 and 8 to a second dispensing aperture in a second disk member.

In operation, a container of product tablets 168 is docked onto the hopper 101. A signal is provided to the tablet dispenser 100 to dispense product at the desired time. If the tablet dispenser 100 is used with a dishwashing machine to dispense a sanitizing product, the dishwashing machine will signal delivery of the product tablet 168 for the sanitizing rinse cycle of the dishwashing machine. Power is applied to the motor 172 or gear head to begin rotation of the dynamic disk members 112 and 127. Rotation of the disk member 112 assists in the first dispensing aperture 115 receiving a product tablet 168 within the hopper 101, as shown in FIG. 8. As the first disk member 112 rotates, the first dispensing aperture 115 of the first disk member 112 aligns with the second dispensing aperture 123 of the second disk member 120 and the product tablet 168 is transferred from the first dispensing aperture 115 to the second dispensing aperture 123, as shown in FIG. 9. The wiper 109 blocks additional product tablets 168 from entering the first dispensing aperture 115 when aligned with the second dispensing aperture 123.

Figure 10:
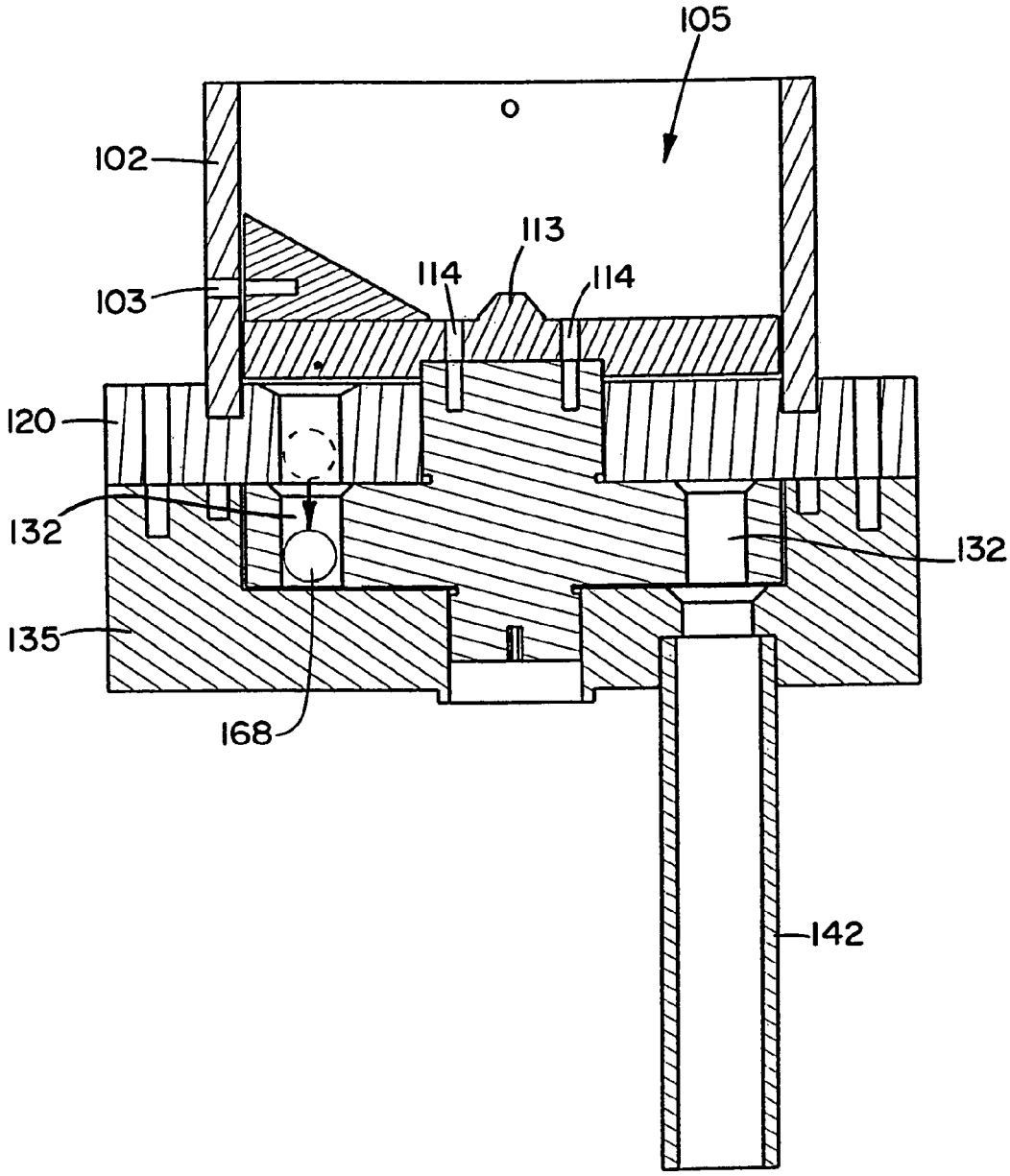
FIG. 10 is a side cross-sectional view of the tablet dispenser shown in FIG. 1 showing the product tablet being transferred from the second dispensing aperture shown in FIG. 9 to a third dispensing aperture in a third disk member.
Figure 11:
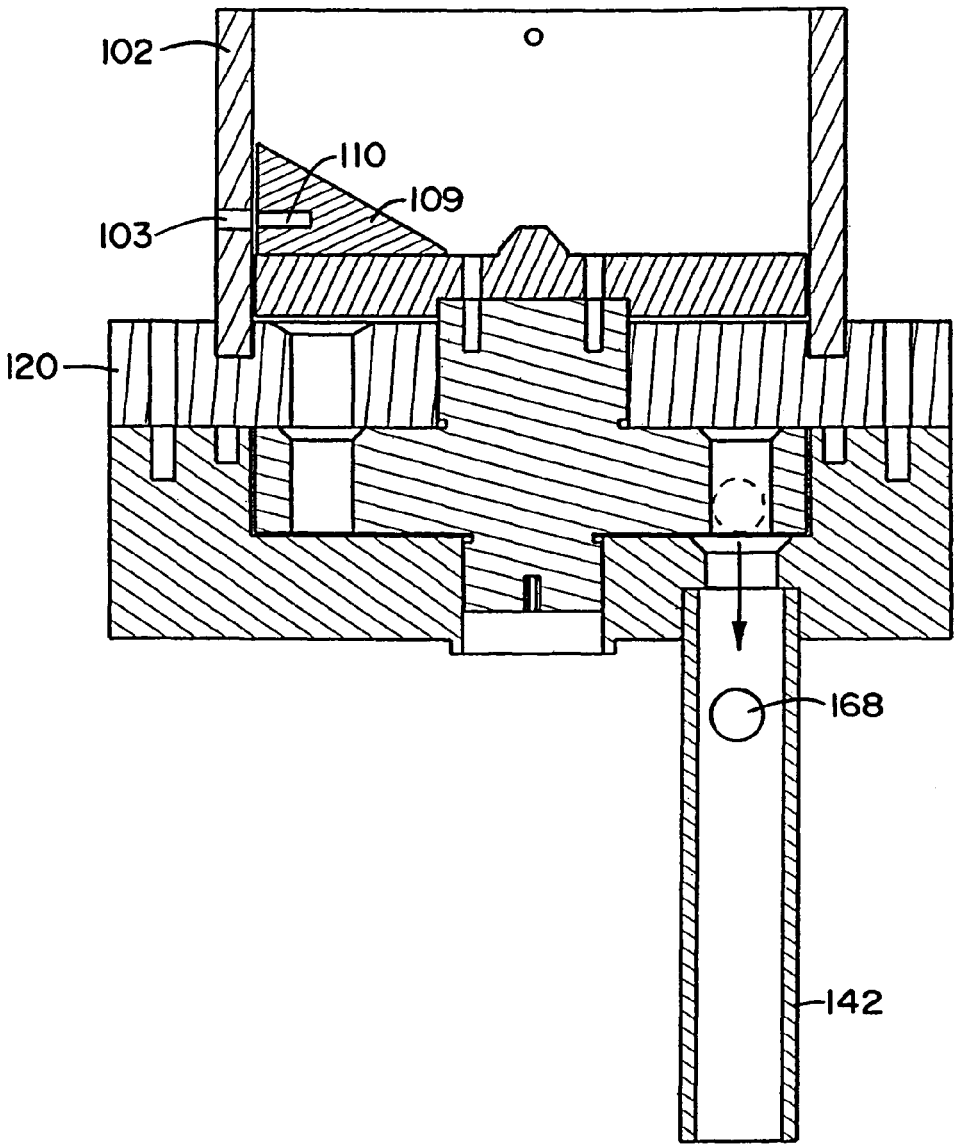
FIG. 11 is a side cross-sectional view of the tablet dispenser shown in FIG. 1 showing the product tablet being transferred from the third dispensing aperture rotated 180 degrees from the position shown in FIG. 10 to a fourth dispensing aperture in a fourth disk member and an outlet conduit.

As the third disk member 127 rotates, preferably concurrently with the first disk member 112, the third dispensing aperture 132 aligns with the second dispensing aperture 123 and the product tablet 168 is transferred from the second dispensing aperture 123 to the third dispensing aperture 132, as shown in FIG. 10. The third dispensing aperture 132 and the first dispensing aperture 115 are positioned at different locations with respect to the second dispensing aperture 123 thereby aligning with the second dispensing aperture 123 at separate times resulting in an interrupted flow path for the product tablets 168. As the third disk member 127 continues to rotate, the third dispensing aperture 132 aligns with the fourth dispensing aperture 139 of the fourth disk member 135 and the product tablet 168 is transferred from the third dispensing aperture 132 to the fourth dispensing aperture 139, as shown in FIG. 11. The fourth dispensing aperture 139 is in fluid communication with the outlet conduit 142, and the product tablet 168 is then dispensed through the outlet conduit 142 into the dishwashing machine.

As the product tablets 168 flow through the outlet conduit 142, as shown in FIG. 12, the sensor mechanism 155 detects the delivery of the product tablet 168 into the dishwashing machine. When the delivery is sensed, the motor 172 or gear head is stopped and a delivery message is displayed. If no product tablet 168 is sensed within a specified time period, the motor 172 is stopped and an out of product message is displayed indicating that another container of product tablets 168 needs to be installed.

Figure 13:
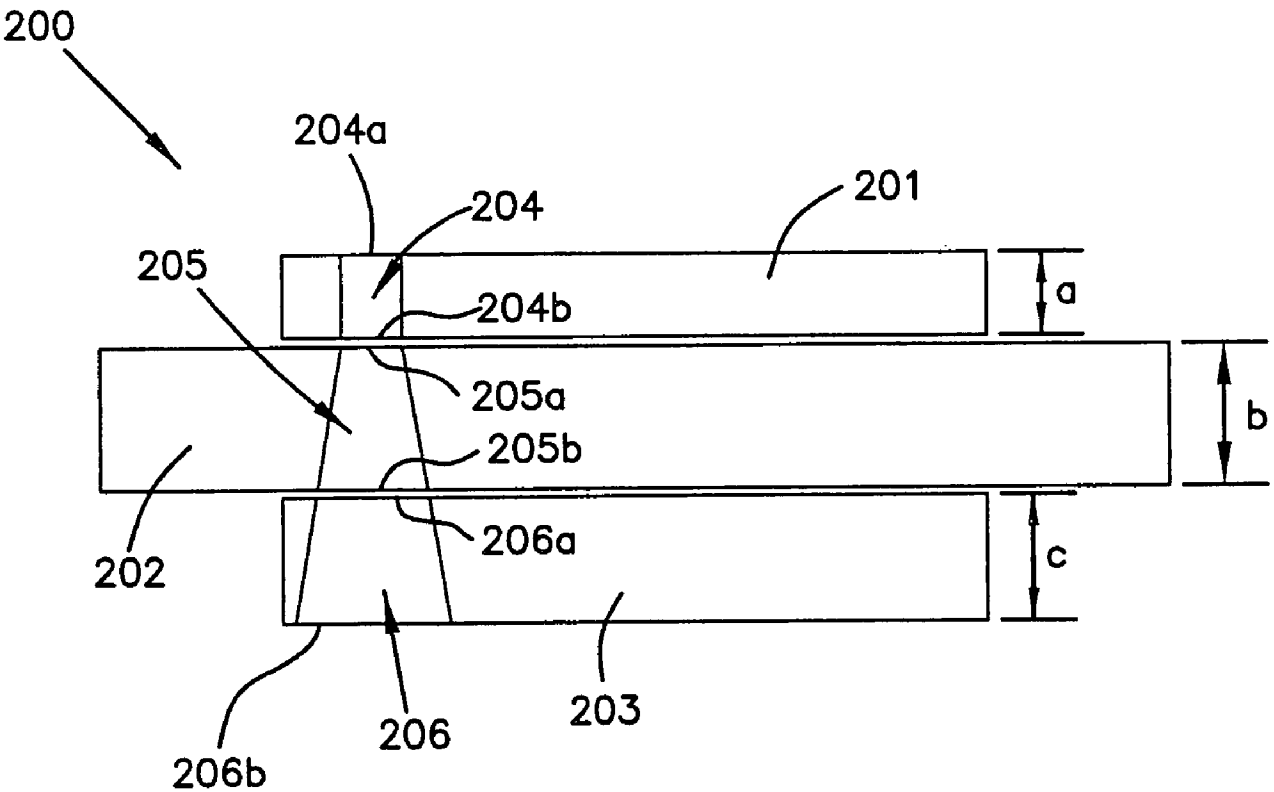
FIG. 13 is a schematic drawing of disk members having dispensing apertures in another embodiment tablet dispenser constructed according to the principles of the present invention.

FIG. 13 shows a schematic drawing of three disk members having dispensing apertures of another embodiment tablet dispenser 200. The first disk member 201 preferably has a thickness a between ⅜ and ½ inch, and the second disk member 202 and the third disk member 203 preferably each have a thickness larger than the thickness of the first disk member 201. Preferably, the thickness b of the second disk member 202 and the thickness c of the third disk member 203 are between ¾ and ⅞ inch.

In addition, the first disk member 201 includes a first dispensing aperture 204, the second disk member 202 includes a second dispensing aperture 205, and the third disk member includes a third dispensing aperture 206. Preferably, the first dispensing aperture 204 has a diameter configured and arranged to contain a predetermined quantity of product tablets thereby assisting in dispensing the desired dose of product. The second dispensing aperture 205 has a diameter larger than the diameter of the first dispensing aperture 204, and the third dispensing aperture 206 has a diameter larger than the diameter of the second dispensing aperture 205.

Most preferably, the dispensing apertures are tapered with a smaller diameter top and a larger diameter bottom, the adjacent tops and bottoms being approximately the same diameter. This ensures that there is more room for the product tablets proximate the bottom of each disk member, which assists in preventing jamming of the product tablets and assists in dispensing of the product tablets. The first dispensing aperture 204 of the first disk member 201 may or may not be tapered.

For product tablets having a diameter of approximately ⅜ inch, the dispensing aperture 204 preferably has a top diameter 204*a* and a bottom diameter 204*b* of slightly greater than ⅜ inch, preferably approximately 0.438 inch. The dispensing aperture 205 preferably has a top diameter 205*a* of approximately the same as the diameters 204*a* and 204*b* and a bottom diameter 205*b* of approximately 0.503 inch. The dispensing aperture 206 preferably has a top diameter 206*a* of approximately the same as the diameter 205*b* and a bottom diameter 206*b* of approximately 0.566 inch. The preferred diameters may be +/−0.020 inch.

As the product tablets are dispensed from the first disk member 201, to the second disk member 202, and to the third disk member 203, the thickness of the second disk member 202 and the third disk member 203 are larger than the thickness of the first disk member 201 and the diameters of the dispensing apertures increase. Therefore, the volumes of the dispensing apertures increase, which assists in reducing the occurrence of the product tablets jamming in the tablet dispenser 200. If the dispensing apertures are tapered, this further reduces the occurrence of the product tablets jamming in the table dispenser 200.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A dispenser for dispensing product tablets, comprising:

a. a hopper having a cavity and a bottom, the cavity being configured and arranged to contain the product tablets, the bottom including an opening providing access to the cavity;

b. a first disk member configured and arranged to fit within the cavity proximate the opening of the hopper, the first disk member including a first aperture extending longitudinally through the first disk member;

c. a second disk member to which the bottom of the hopper is operatively connected, the second disk member being stationary and including a bore and a second aperture, the bore extending longitudinally through the second disk member proximate a center portion of the second disk member, the second aperture extending longitudinally through the second disk member and being intermittently aligned with the first aperture;

d. a third disk member including a boss and a third aperture, the boss extending through the bore of the second disk member and interconnecting the third disk member and the first disk member, the third disk member and the first disk member being rotatable, the third aperture extending longitudinally through the third disk member and being intermittently aligned with the second aperture, the third aperture and the first aperture being positioned at different angles with respect to the second aperture;

e. a motor operatively connected to the third disk member, the motor rotating the third disk member thereby rotating the first disk member; and f. a flow path created by aligning the apertures, the first aperture aligning with the second aperture and the third aperture aligning with the second aperture as the first disk member and the third disk member are rotated by the motor, wherein the flow path is interrupted thereby sealing the hopper from outside elements.

2. The tablet dispenser of claim 1, further comprising an outlet conduit in fluid communication with the third aperture.

3. The tablet dispenser of claim 2, wherein the outlet conduit and the third aperture are in fluid communication at a position of rotation away from the flow path.

4. The tablet dispenser of claim 2, further comprising a fourth disk member to which the outlet conduit is operatively connected, the fourth disk member including a fourth aperture in fluid communication with the outlet tube, the third aperture aligning with the fourth aperture during rotation away from the flow path.

5. The tablet dispenser of claim 2, further comprising a sensor mechanism proximate the outlet conduit, the sensor mechanism sensing when product has been dispensed from the outlet conduit.

6. The tablet dispenser of claim 1, further comprising a wiper operatively connected to the hopper proximate the first disk member and in alignment with the second aperture, wherein less than two product tablets are contained within the first aperture, the wiper removing product tablets proximate the first aperture as the first aperture approaches the second aperture thereby ensuring less than two product tablets flow from the first aperture into the second aperture as the first disk member rotates.

7. The tablet dispenser of claim 6, further comprising a ramp guiding product tablets into the first aperture, wherein the excess product tablets are eased away from proximate the first aperture along the ramp by the wiper, the ramp reducing an occurrence of breakage of the excess product tablets as the first disk member is rotated.

8. The tablet dispenser of claim 1, wherein the first aperture has a first diameter, the second aperture has a second diameter, and the third aperture has a third diameter, the first diameter being configured and arranged to contain a predetermined quantity of product tablets, the second diameter being larger than the first diameter, and the third diameter being larger than the second diameter thereby reducing an occurrence of jamming.

9. The tablet dispenser of claim 8, wherein the first disk member has a smaller thickness than the second disk member and the third disk member.

10. The tablet dispenser of claim 1, wherein the first aperture and the third aperture are 90 degrees apart with respect to each other.

11. A dispenser for dispensing product tablets, comprising:

a. a hopper having a cavity and a bottom, the cavity being configured and arranged to contain the product tablets, the bottom including an opening providing access to the cavity;

b. a first disk member configured and arranged to fit within the cavity proximate the opening of the hopper, the first disk member including a first aperture extending longitudinally through the first disk member;

c. a second disk member to which the bottom of the hopper is operatively connected, the second disk member being stationary and including a bore and a second aperture, the bore extending longitudinally through the second disk member proximate a center portion of the second disk member, the second aperture extending longitudinally through the second disk member and being intermittently aligned with the first aperture;

d. a third disk member including a boss and a third aperture, the boss extending through the bore of the second disk member and interconnecting the third disk member and the first disk member, the third disk member and the first disk member being rotatable, the third aperture extending longitudinally through the third disk member and being intermittently aligned with the second aperture, the third aperture and the first aperture being positioned at different angles with respect to the second aperture;

e. a motor operatively connected to the third disk member, the motor rotating the third disk member thereby rotating the first disk member;

f. a flow path created by aligning the apertures, the first aperture aligning with the second aperture and the third aperture aligning with the second aperture as the first disk member and the third disk member are rotated by the motor, wherein the flow path is interrupted thereby isolating the hopper from outside elements;

g. an outlet conduit in fluid communication with the third aperture wherein the outlet conduit and the third aperture are in fluid communication at a position of rotation away from the flow path; and h. a fourth disk member to which the outlet conduit is operatively connected, the fourth disk member including a fourth aperture in fluid communication with the outlet tube, the third aperture aligning with the fourth aperture during rotation away from the flow path.

* * * * *